US008204406B2

(12) United States Patent
Inui et al.

(10) Patent No.: US 8,204,406 B2
(45) Date of Patent: Jun. 19, 2012

(54) IMAGE FORMING APPARATUS

(75) Inventors: Hiroshi Inui, Osaka (JP); Kazuya Yamashita, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 52 days.

(21) Appl. No.: 12/558,403

(22) Filed: Sep. 11, 2009

(65) Prior Publication Data

US 2010/0067941 A1 Mar. 18, 2010

(30) Foreign Application Priority Data

Sep. 16, 2008 (JP) ..... 2008-236655

(51) Int. Cl.
*G03G 21/00* (2006.01)

(52) U.S. Cl. ..... 399/124; 399/114; 220/523; 220/822

(58) Field of Classification Search ..... 399/107, 399/110, 114, 124; 220/376, 523, 531, 810, 220/817–820, 822–824, 836, 839, 843, 845
See application file for complete search history.

(56) References Cited

U.S. PATENT DOCUMENTS

2003/0170047 A1* 9/2003 Yoshida ..... 399/110

FOREIGN PATENT DOCUMENTS

JP 2007-187815 7/2007

* cited by examiner

*Primary Examiner* — David Porta
*Assistant Examiner* — Benjamin Schmitt
(74) *Attorney, Agent, or Firm* — Knobbe, Martens, Olson & Bear, LLP

(57) ABSTRACT

An image forming apparatus includes a housing having an opening, a cover portion that can be disposed so as to cover the opening, a first connecting portion that connects the cover portion with the housing so that the cover portion is pivotable about a first pivotal axis and can switch between a closed state in which the opening is covered and an opened state in which the opening is exposed, a decorative portion that is disposed to be aligned with the cover portion on a side to the first pivotal axis in the cover portion, and forms a predetermined outer face of the housing along with the cover portion in the closed state, and a second connecting portion that connects the decorative portion with the housing so that the decorative portion is pivotable about a second pivotal axis, which is substantially parallel to the first pivotal axis.

7 Claims, 7 Drawing Sheets

IMAGE FORMING APPARATUS

This application is based on and claims the benefit of priority from Japanese Patent Application No. 2008-236655, filed on 16 Sep. 2008, the content of which is incorporated herein by reference.

BACKGROUND OF THE INVENTION

1. Field of the Invention

The present invention relates to an image forming apparatus.

2. Related Art

Conventionally, an image forming apparatus such as a copy machine has a cover that is configured so as to be able to expose the inside of a housing main body for replacement and repair of inner members. For example, an image forming apparatus having a cover (door) that is configured to be openable in a horizontal direction and to be able to expose the inside thereof is proposed.

Here, in a case where the cover is disposed to be aligned above in a vertical direction of a cassette for storing paper, the cover may be formed so that an end thereof is aligned, in the vertical direction, with an end of the cassette, in order to satisfy design requirements.

In this case, an end of the cover is attached so as to be pivotable about a pivotal axis at a position a predetermined distance inward from an outer edge in the horizontal direction of the housing main body. In addition, a decorative portion is disposed in a predetermined region from the end of the cover portion, including the outer edge in the horizontal direction, in order to avoid exposure of the inner members.

SUMMARY OF THE INVENTION

Here, even in the abovementioned image forming apparatus, in a case where the abovementioned decorative portion is disposed to be aligned with the cover in the predetermined region including the outer edge on a side to the pivotal axis, pivotal movement of the cover in the horizontal direction is restricted in some cases.

The present invention aims at providing an image forming apparatus including a cover portion that is pivotable about a first pivotal axis and a decorative portion that is disposed to be aligned with the cover portion on a side to the first pivotal axis in the cover portion, and is pivotable about a second pivotal axis that is substantially parallel to the first pivotal axis in a direction the same as the cover portion.

The present invention relates to an image forming apparatus including: a housing having an opening; a cover portion that can be disposed so as to cover the opening; a first connecting portion that connects the cover portion with the housing so that the cover portion is pivotable about a first pivotal axis and can switch between a closed state in which the opening is covered and an opened state in which the opening is exposed; a decorative portion that is disposed to be aligned with the cover portion on a side to the first pivotal axis in the cover portion, and forms a predetermined outer face of the housing along with the cover portion in the closed state; and a second connecting portion that connects the decorative portion with the housing so that the decorative portion is pivotable about a second pivotal axis, which is coaxial with or substantially parallel to the first pivotal axis, in a direction substantially the same as the cover portion.

According to the present invention, an image forming apparatus can be provided that includes a cover portion that is pivotable about a first pivotal axis and a decorative portion that is disposed to be aligned with the cover portion on a side to the first pivotal axis in the cover portion, and is pivotable about a second pivotal axis that is substantially parallel to the first pivotal axis in a direction the same as the cover portion.

DETAILED DESCRIPTION OF THE INVENTION

A preferred embodiment of the present invention is described hereinafter with reference to the drawings.

Figure 1:
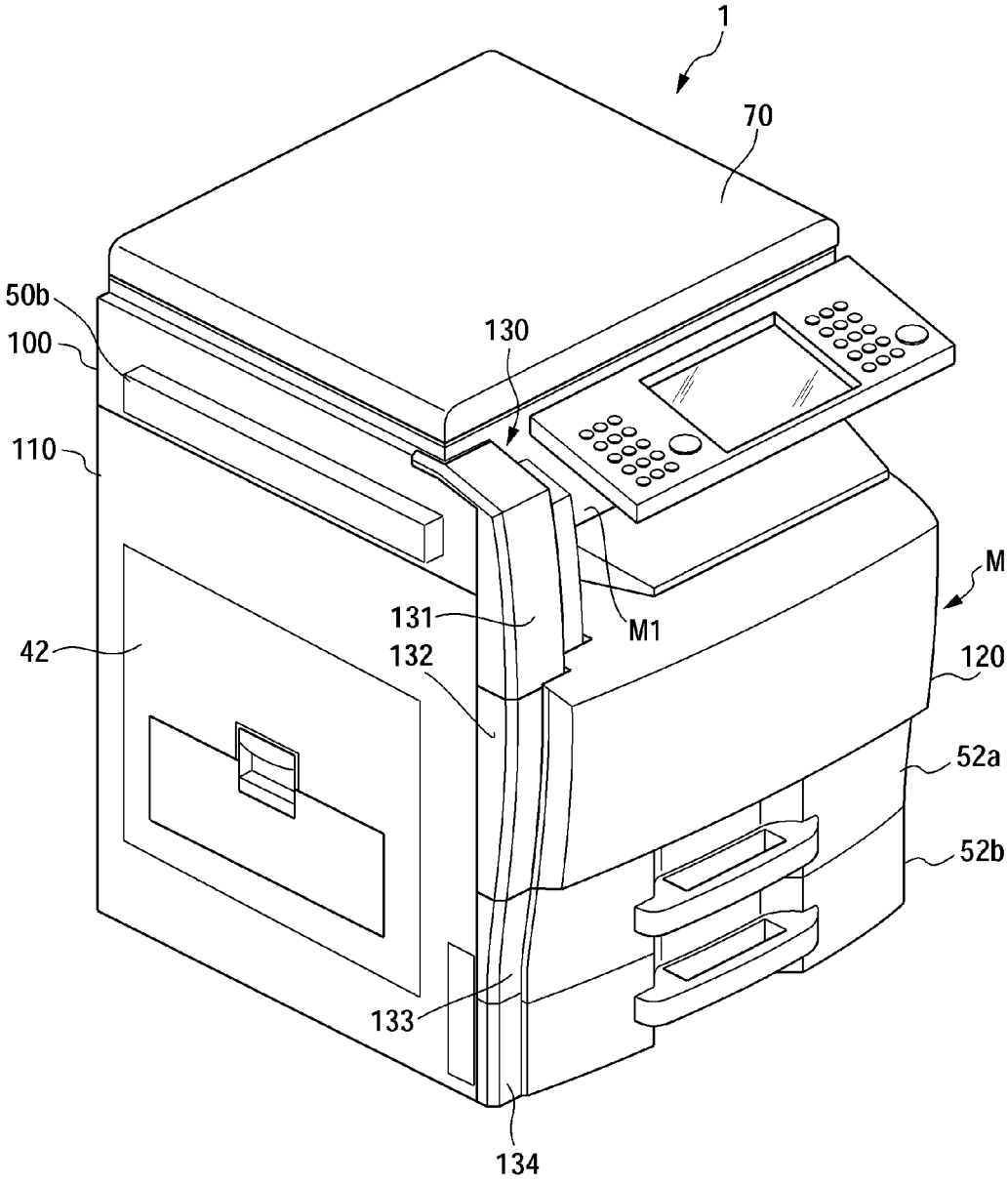
FIG. 1 is a perspective view of a copy machine.
Figure 2:
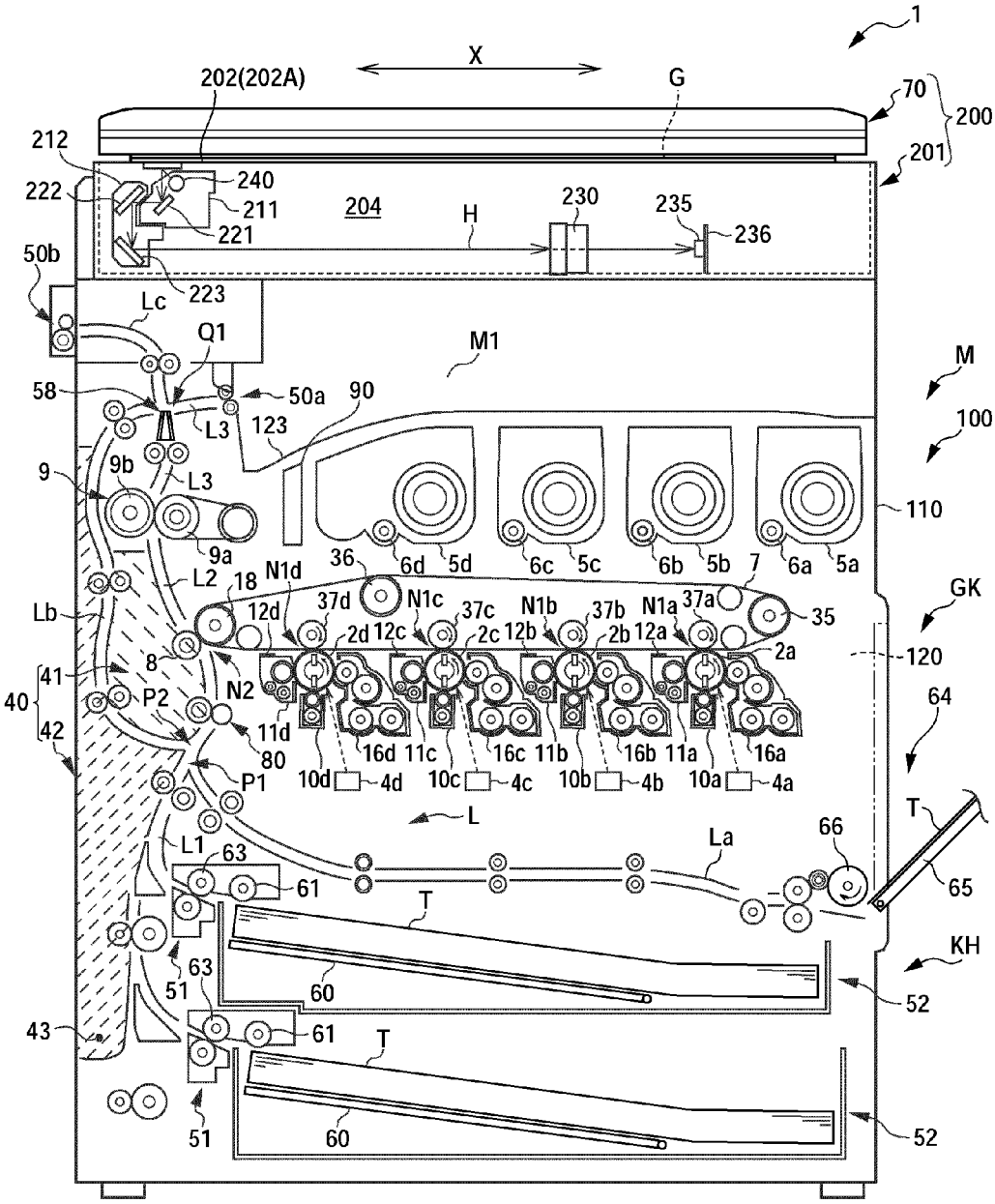
FIG. 2 is a front view illustrating an arrangement of components of the copy machine.
Figure 3:
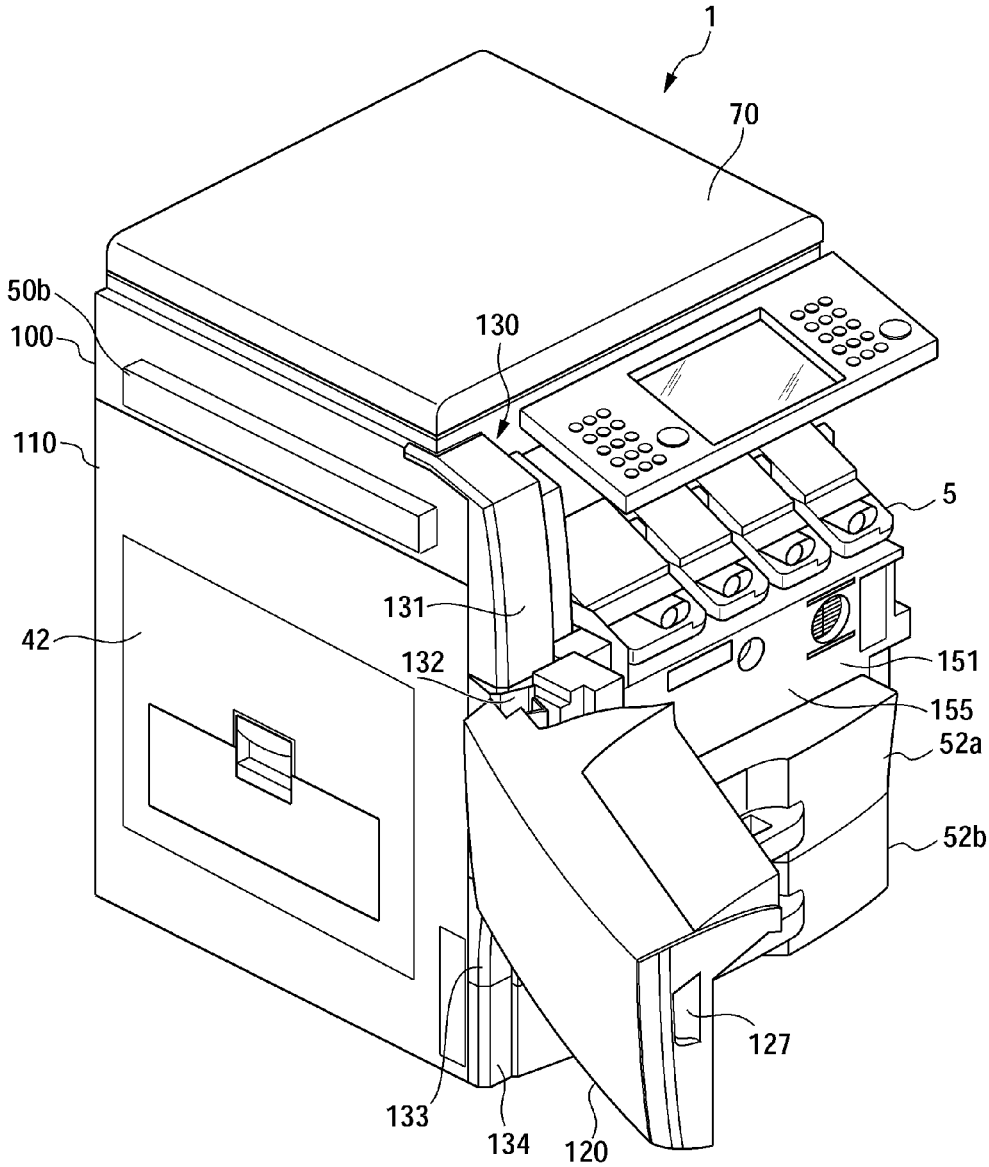
FIG. 3 is a perspective view of the copy machine in a state where a cover portion is opened.

An overall structure of a copy machine 1 as an image forming apparatus according to the present embodiment is described referring to FIGS. 1 to 3. FIG. 1 is a perspective view of the copy machine 1 with a cover portion 120 in a closed state. FIG. 2 is a diagram illustrating an arrangement of components of the copy machine 1. FIG. 3 is a perspective view of the copy machine 1 with a cover portion 120 in an opened state.

As shown in FIGS. 1 to 3, the copy machine 1 as the image forming apparatus includes: an image reading device 200 disposed on an upper side thereof; and a device main body M disposed on a lower side thereof that forms a toner image on a paper T, as a sheet-shaped material to which the toner image is transferred, based on image information from the image reading device 200.

An image reading device 200 is described hereinafter.

As shown in FIG. 2, the image reading device 200 includes a flap member 70 and a reader portion 201 that reads an image on an original G.

The flap member 70 is connected with the reader portion 201 by means of a connecting portion (not shown) so as to be openable and closable. The flap member 70 protects a reading surface 202A (described later).

The reader portion 201 includes: the reading surface 202A; a lamp 240 as a light source disposed in an internal space 204 of the reader portion 201; a plurality of mirrors 221, 222, and 223; an imaging lens 230; a CCD 235 as a reading device; and a CCD substrate 236 that performs a predetermined process with respect to image data read by the CCD 235 and outputs the image data to a device main body M.

The reading surface 202A is formed along an upper face in a vertical direction of a contact glass 202 on which the original G is placed.

The reader portion 201 includes a first frame body 211 and a second frame body 212 that are disposed in the internal space 204 and move in a direction parallel to the reading surface 202A. The abovementioned lamp 240 and the mirror 221 are housed in the first frame body 211. The mirrors 222 and 223 are housed in the second frame body 212.

In the internal space 204 of the reader portion 201, the plurality of mirrors 221, 222 and 223 forms a light path H so that light from the original G is incident upon the imaging lens 230. In addition, since the first frame body 211 moves in a sub-scanning direction X at a predetermined speed A while the second frame body 212 moves in the sub-scanning direction X at a predetermined speed A/2, the length of the light path H is kept constant even while reading an image. As a result, an image of the original G placed on the reading surface 202A is read.

The device main body M is described hereinafter.

The device main body M includes: an image forming portion GK that forms a predetermined image on the paper T based on image information; and a paper feeding/ejection portion KH that feeds the paper T to the image forming portion GK and ejects the paper T on which an image is formed.

As shown in FIG. 2, the image forming portion GK includes: photoreceptor drums 2*a*, 2*b*, 2*c*, and 2*d* as image supporting bodies (photoreceptors); charging portions 10*a*, 10*b*, 10*c*, and 10*d*; laser scanner units 4*a*, 4*b*, 4*c*, and 4*d* as exposure units; developing units 16*a*, 16*b*, 16*c*, and 16*d*; toner cartridges 5*a*, 5*b*, 5*c*, and 5*d*; toner feeding portions 6*a*, 6*b*, 6*c*, and 6*d*; drum cleaning portions 11*a*, 11*b*, 11*c*, and 11*d*; static eliminator 12*a*, 12*b*, 12*c*, and 12*d*; an intermediate transfer belt 7; primary transfer rollers 37*a*, 37*b*, 37*c*, and 37*d*; a secondary transfer roller 8; an opposing roller 18; and a fixing device 9.

As shown in FIG. 2, the paper feeding/ejection portion KH includes a paper feeding cassette 52, a manual feeding portion 64, a paper path L for the paper T, a resist roller pair 80, a first ejection portion 50*a*, and a second ejection portion 50*b*.

Components of the image forming portion GK and the paper feeding/ejection portion KH are described in detail hereinafter. First, a description is provided for the image forming portion GK.

In the image forming portion GK, charging by the charging portions 10*a*, 10*b*, 10*c*, and 10*d*; exposure by the laser scanner units 4*a*, 4*b*, 4*c*, and 4*d*; development by the developing units 16*a*, 16*b*, 16*c*, and 16*d*; primary transfer by the intermediate transfer belt 7 and the primary transfer rollers 37*a*, 37*b*, 37*c*, and 37*d*; static elimination by the static eliminators 12*a*, 12*b*, 12*c*, and 12*d*; and cleaning by the drum cleaning portions 11*a*, 11*b*, 11*c*, and 11*d*, from an upstream side to a downstream side, are performed on a surface of the photoreceptor drums 2*a*, 2*b*, 2*c*, and 2*d*.

In addition, secondary transfer by the intermediate transfer belt 7, the secondary transfer roller 8 and the opposing roller 18, and fixing by the fixing device 9 are performed in the image forming portion GK.

The photoreceptor drums 2*a*, 2*b*, 2*c*, and 2*d* are composed of cylindrically shaped members and function as photoreceptors or image supporting bodies. The photoreceptor drums 2*a*, 2*b*, 2*c*, and 2*d* are disposed so as to be rotatable in a direction of an arrow, about an axis that extends in a vertical direction with respect to a direction of movement of the intermediate transfer belt 7. An electrostatic latent image can be formed on a surface of each of the photoreceptor drums 2*a*, 2*b*, 2*c*, and 2*d*.

The charging portions 10*a*, 10*b*, 10*c*, and 10*d* are disposed so as to face a surface of the photoreceptor drums 2*a*, 2*b*, 2*c*, and 2*d*, respectively. The charging portions 10*a*, 10*b*, 10*c*, and 10*d* uniformly negatively charge (negative polarity) or positively charge (positive polarity) the surface of the photoreceptor drums 2*a*, 2*b*, 2*c*, and 2*d*, respectively.

The laser scanner units 4*a*, 4*b*, 4*c*, and 4*d* function as exposure units and are disposed to be spaced apart from the surface of the photoreceptor drums 2*a*, 2*b*, 2*c*, and 2*d*, respectively. The laser scanner units 4*a*, 4*b*, 4*c*, and 4*d* are configured to each include a laser light source, a polygonal mirror, a polygonal mirror driving motor and the like, which are not shown.

The laser scanner units 4*a*, 4*b*, 4*c*, and 4*d* scan and expose the surface of the photoreceptor drums 2*a*, 2*b*, 2*c*, and 2*d* respectively, based on image information read by the reader portion 201. By being scanned and exposed by the laser scanner units 4*a*, 4*b*, 4*c*, and 4*d*, an electric charge of an exposed portion of the surface of each of the photoreceptor drums 2*a*, 2*b*, 2*c*, and 2*d* is removed. In this way, an electrostatic latent image is formed on a surface of each of the photoreceptor drums 2*a*, 2*b*, 2*c*, and 2*d*.

The developing units 16*a*, 16*b*, 16*c*, and 16*d* are disposed so as to correspond to the photoreceptor drums 2*a*, 2*b*, 2*c*, and 2*d*, respectively, and so as to face the surface of the photoreceptor drums 2*a*, 2*b*, 2*c*, and 2*d*. The developing units 16*a*, 16*b*, 16*c*, and 16*d* each form a toner image of each color on the surface of the photoreceptor drums 2*a*, 2*b*, 2*c*, and 2*d* by depositing toner of each color on the electrostatic latent image formed on the surface of each of the photoreceptor drums 2*a*, 2*b*, 2*c*, and 2*d*. The developing units 16*a*, 16*b*, 16*c*, and 16*d* correspond to the four colors of yellow, cyan, magenta, and black, respectively. The developing units 16*a*, 16*b*, 16*c*, and 16*d* are configured to include developing rollers that are disposed to face the photoreceptor drums 2*a*, 2*b*, 2*c*, and 2*d*, stirring rollers for stirring toners, respectively, and the like.

The toner cartridges 5*a*, 5*b*, 5*c*, and 5*d* are provided so as to correspond to the developing units 16*a*, 16*b*, 16*c*, and 16*d*, respectively, and store toners of the colors that are supplied to the developing units 16*a*, 16*b*, 16*c*, and 16*d*, respectively. The toner cartridges 5*a*, 5*b*, 5*c*, and 5*d* store toners of yellow, cyan, magenta, and black respectively.

The toner cartridges 5*a*, 5*b*, 5*c*, and 5*d* are disposed so as to be exposed to the outside by pivotal movement of the cover portion 120. In other words, in a case where the toner cartridges 5*a*, 5*b*, 5*c*, and 5*d* are to be replaced, the cover portion 120 is moved horizontally outwards so as to expose the toner cartridges 5*a*, 5*b*, 5*c*, and 5*d* to such a degree that each of the toner cartridges 5*a*, 5*b*, 5*c*, and 5*d* can be replaced, respectively (see FIG. 3).

The toner feeding portions 6*a*, 6*b*, 6*c*, and 6*d* are provided so as to correspond to the toner cartridges 5*a*, 5*b*, 5*c*, and 5*d* and the developing units 16*a*, 16*b*, 16*c*, and 16*d* respectively, and supply the toners of the colors stored in the toner cartridges 5*a*, 5*b*, 5*c*, and 5*d* to the developing units 16*a*, 16*b*, 16*c*, and 16*d*, respectively. The toner feeding devices 6*a*, 6*b*, 6*c*, and 6*d* are connected with the developing units 16*a*, 16*b*, 16*c*, and 16*d*, respectively, via toner feeding paths (not shown).

Toner images of respective colors formed on the photoreceptor drums 2*a*, 2*b*, 2*c*, and 2*d* are sequentially primarily transferred to the intermediate transfer belt 7. The intermediate transfer belt 7 is stretched around a driving roller 35, the opposing roller 18, a tension roller 36 and the like. Since the tension roller 36 biases the intermediate transfer belt 7 from the inside to the outside, a predetermined tension is applied to the intermediate transfer belt 7.

The primary transfer rollers 37*a*, 37*b*, 37*c*, and 37*d* are disposed across the intermediate transfer belt 7 from the photoreceptor drums 2*a*, 2*b*, 2*c*, and 2*d* so as to face the photoreceptor drums 2*a*, 2*b*, 2*c*, and 2*d*, respectively.

Predetermined portions of the intermediate transfer belt 7 are sandwiched between the primary transfer rollers 37*a*, 37*b*, 37*c*, and 37*d* and the photoreceptor drums 2*a*, 2*b*, 2*c*, and 2*d*. The predetermined portions being sandwiched are pressed against surfaces of the photoreceptor drums 2*a*, 2*b*, 2*c*, and 2*d*. Primary transfer nips N1*a*, N1*b*, N1*c*, and N1*d* are formed respectively between the photoreceptor drums 2*a*, 2*b*, 2*c*, and 2*d* and the primary transfer rollers 37*a*, 37*b*, 37*c*, and 37*d*. On each of the primary transfer nips N1*a*, N1*b*, N1*c*, and N1*d*, the toner images of the colors developed on the photoreceptor drums 2*a*, 2*b*, 2*c*, and 2*d* are sequentially transferred to the intermediate transfer belt 7. A full-color toner image is thus formed on the intermediate transfer belt 7.

A primary transfer bias, for transferring the toner images of the colors formed on the photoreceptor drums 2*a*, 2*b*, 2*c*, and 2*d* to the intermediate transfer belt 7, respectively, is applied to each of the primary transfer rollers 37*a*, 37*b*, 37*c*, and 37*d* by primary transfer bias application portions (not shown).

The static eliminators 12*a*, 12*b*, 12*c*, and 12*d* are disposed so as to face a surface of the photoreceptor drums 2*a*, 2*b*, 2*c*, and 2*d*, respectively. The static eliminators 12*a*, 12*b*, 12*c*, and 12*d* each remove electricity (eliminate an electrical charge) from the surface of the photoreceptor drums 2*a*, 2*b*, 2*c*, and 2*d* after the primary transfer, by irradiating light onto the surface of each of the photoreceptor drums 2*a*, 2*b*, 2*c*, and 2*d*.

The drum cleaning portions 11*a*, 11*b*, 11*c*, and 11*d* are disposed so as to face a surface of the photoreceptor drums 2*a*, 2*b*, 2*c*, and 2*d*, respectively. The drum cleaning portions 11*a*, 11*b*, 11*c*, and 11*d* remove toner and attached matter remaining on the surface of the photoreceptor drums 2*a*, 2*b*, 2*c*, and 2*d*, respectively, and carry the removed toner and the like to a predetermined collection mechanism for collection.

The secondary transfer roller 8 secondarily transfers the toner image, which was primarily transferred to the intermediate transfer belt 7, to the paper T. A secondary transfer bias for transferring the full-color toner image formed on the intermediate transfer belt 7 to the paper T is applied to the secondary transfer roller 8, by a secondary transfer bias application portion (not shown).

The secondary transfer roller 8 can be either brought into contact with or spaced apart from the intermediate transfer belt 7. More specifically, the secondary transfer roller 8 is configured to be movable between a contact position that is in contact with the intermediate transfer belt 7 and a spaced position that is spaced apart from the intermediate transfer belt 7. In particular, the secondary transfer roller 8 is moved to the contact position for transferring the toner image primarily transferred to a surface of the intermediate transfer belt 7 to the paper T, and to the spaced position in all other circumstances.

An opposing roller 18 is disposed across the intermediate transfer belt 7 from the secondary transfer roller 8. A part of the intermediate transfer belt 7 is sandwiched between the secondary transfer roller 8 and the opposing roller 18. The paper T is pressed against an outer surface (a side to which the image is primarily transferred) of the intermediate transfer belt 7. A secondary transfer nip N2 is formed between the secondary transfer roller 8 and the opposing roller 18. On the secondary transfer nip N2, the toner image primarily transferred to the intermediate transfer belt 7 is secondarily transferred to the paper T.

The fixing portion 9 fuses and pressurizes color toners constituting the toner image secondarily transferred to the paper T, in order to fix the color toners. The fixing portion 9 includes a heat roller 9*a* that is heated by a heater, and a pressure roller 9*b* that is brought into pressure-contact with the heat roller 9*a*. The heat roller 9*a* and the pressure roller 9*b* sandwich and compress, and convey the paper T to which the toner image is secondarily transferred. The paper T is conveyed in a state of being sandwiched between the heat roller 9*a* and the pressure roller 9*b*, thereby fusing, compressing and fixing the toner transferred thereto.

Next, the paper feeding/ejection portion KH is described.

As shown in FIG. 2, two paper feeding cassettes 52 for housing the paper T are disposed one above the other on a lower side of the device main body M. The paper feeding cassette 52 is configured to be slidable from a housing (the casing body 100) of the device main body M. The paper feeding cassette 52 includes a paper tray 60 on which the paper T is placed. The paper feeding cassette 52 stores the paper T being stacked on the paper tray 60. The paper T stacked on the paper tray 60 is fed to the paper path L by a cassette feeding portion 51 disposed in an end portion of the paper feeding cassette 52 on a side of feeding the paper (in a left end portion of FIG. 2). The cassette feeding portion 51 includes a double feed preventing mechanism composed of: a forward feed roller 61 for picking up the paper T on the paper tray 60; and a paper feeding roller pair 63 for feeding the paper T one sheet at a time to the paper path L.

The manual feeding portion 64 is provided on a right lateral face (the right side in FIG. 2) of the device main body M. The manual feeding portion 64 is provided primarily for the purpose of feeding paper T that is different in size from the paper T stored in the paper feeding cassette 52 to the device main body M. The manual feeding portion 64 includes the manual feeding tray 65, which constitutes a portion of the device main body M in a closed state, and a paper feeding roller 66. A lower end of the manual feeding tray 65 is connected in the vicinity of the paper feeding roller 66, so as to be pivotable (openable and closable). The paper T is placed on the manual feeding tray 65 in an opened state. The manual feeding portion 64 feeds the paper T placed on the manual feeding tray 65 in an opened state to a manual feeding path La.

A first ejection portion 50*a* and a second ejection portion 50*b* are provided on an upper side of the device main body M. The first ejection portion 50*a* and the second ejection portion 50*b* eject the paper T to the outside of the device main body M. The first ejection portion 50*a* and the second ejection portion 50*b* are described later in detail.

The paper path L includes: a first paper path L1 from the cassette feeding portion 51 to the secondary transfer nip N2; a second paper path L2 from the secondary transfer nip N2 to the fixing portion 9; a third paper path L3 from the fixing portion 9 to the first ejection portion 50*a*; the manual paper path La that guides paper fed from the manual feeding portion 64 to the first paper path L1; a reverse paper path Lb that reverses and returns the paper T that is conveyed in the third paper path L3 to the first paper path L1; and a post-processing paper path Lc that conveys the paper that is conveyed in the third paper path L3 to a post-processing device (not shown) connected to the second ejection portion 50*b*.

In addition, a first junction P1 and a second junction P2 are provided in the middle of the first paper path L1. A first branch portion Q1 is provided in the middle of the third paper path L3.

The first junction P1 is a junction where the manual paper path La joins the first paper path L1. The second junction P2 is a junction where the reverse paper path Lb joins the first paper path L1.

The first branch portion Q1 is a branch portion where the post-processing paper path Lc branches off from the third paper path L3. A switching member 58 is provided in the first branch portion Q1. The switching member 58 shifts (switches) a conveying direction of the paper T discharged from the fixing portion 9 to the third paper path L3 leading to the first ejection portion 50*a* or to the post-processing paper path Lc leading to the second ejection portion 50*b*.

In addition, a sensor for detecting the paper T and a resist roller pair 80 for skew compensation of the paper T and timing adjustment with respect to the toner image are disposed in the middle of the first paper path L1 (more specifically, between the second junction P2 and the secondary transfer roller 8). The sensor is disposed immediately before the resist roller pair 80 in a conveying direction of the paper T (on an upstream side in the conveying direction of the paper T). The resist roller pair 80 conveys the paper T while performing the abovementioned compensation and the timing adjustment based on detection information from the sensor.

For a case of performing duplex printing on the paper T, a reverse paper path Lb is provided, which is a paper path for making an opposite surface (an unprinted surface), to a surface that has already been printed, face toward the intermediate transfer belt 7. The reverse paper path Lb can reverse and return the paper T, conveyed from the first branch portion Q1 toward the ejection portion 50, to the first paper path L1, in order to convey the paper T to an upstream side of the resist roller pair 80 disposed on an upstream side of the secondary transfer roller 8. A toner image is transferred from the intermediate transfer belt 7 to a non-print side of the paper T that is reversed by the reverse paper path Lb.

The first ejection portion 50*a* is formed in an end portion of the third paper path L3. The first ejection portion 50*a* is disposed on an upper side of the device main body M. The first ejection portion 50*a* has an opening toward a right lateral face of the device main body M (right side in FIG. 2 and on a side of the manual feeding portion 64). The first ejection portion 50*a* ejects the paper T that is conveyed in the third paper path L3 to the outside of the device main body M.

An ejected paper accumulating portion M1 is formed on a side to the opening of the first ejection portion 50*a*. The ejected paper accumulating portion M1 is formed on an upper face (outer face) of the device main body M. The ejected paper accumulating portion M1 is a portion of the upper face of the device main body M formed to be depressed downward. A bottom face of the ejected paper accumulating portion M1 constitutes a part of the upper face of the device main body M. The paper T, to which an image is formed, ejected from the first ejection portion 50*a* is stacked and accumulated in the ejected paper accumulating portion M1.

The second ejection portion 50*b* is formed in an end portion of the post-processing paper path Lc. The second ejection portion 50*b* is disposed on the upper side of the device main body M. The second ejection portion 50*b* has an opening toward a left lateral face of the device main body M (left side in FIG. 2 and on a side to which the post-processing device is connected). The second ejection portion 50*b* ejects the paper T, which is conveyed in the post-processing paper path Lc, to the outside of the device main body M.

The post-processing device (not shown) is connected to a side to the opening of the second ejection portion 50*b*. The post-processing device performs post processing (stapling, punching and the like) of the paper ejected from the image forming apparatus (copy machine 1).

It should be noted that a sensor for detecting paper is disposed in a predetermined position on each paper path.

Next, a structure for eliminating paper jams in main paper paths L1 to L3 (the first paper path L1, the second paper path L2, and the third paper path L3 are also collectively referred to as "main paper paths" hereinafter) and in the reverse paper path Lb is briefly described.

As shown in FIG. 2, on a left lateral face side of the device main body M (left side in FIG. 2), the main paper paths L1 to L3 and the reverse paper path Lb are disposed in parallel so as to extend mainly in a vertical direction. On a left lateral face side of the device main body M (left side in FIG. 2), a cover body 40 is provided so as to form a portion of the lateral face of the device main body M. A lower end portion of the cover body 40 is connected with the device main body M via a fulcrum shaft 43. The fulcrum shaft 43 is disposed so that an axial direction thereof is along a direction intersecting the main paper paths L1 to L3 and the reverse paper path Lb. The cover body 40 is configured to be pivotable about the fulcrum shaft 43 between a closed position (shown in FIG. 2) and an opened position (not shown).

The cover body 40 is composed of a first cover portion 41 that is connected with the device main body M to be pivotable by the fulcrum shaft 43 and a second cover portion 42 that is connected with the device main body M to be pivotable by the same fulcrum shaft 43. The second cover portion 42 is positioned more to an external side (lateral face side) of the device main body M than the first cover portion 41. It should be noted that, in FIG. 2, the first cover portion 41 is a part hatched with falling diagonal broken lines from top left to bottom right, and the second cover portion 42 is a part hatched with rising diagonal broken lines from bottom left to top right.

In a state where the cover body 40 is in a closed position, an outer face side of the first cover portion 41 constitutes a portion of an outer face (lateral face) of the device main body M.

In addition, in a state where the cover body 40 is in the closed position, an inner face side (a side to the device main body M) of the second cover portion 42 constitutes a portion of the main paper paths L1 to L3.

Furthermore, in a state where the cover body 40 is in the closed position, an inner face side of the first cover portion 41 and an outer face side of the second cover portion 42 constitute at least a portion of the reverse paper path Lb. In other words, the reverse paper path Lb is formed between the first cover portion 41 and the second cover portion 42.

Since the copy machine 1 according to the present embodiment is provided with the cover body 40 thus configured, in a case where a paper jam occurs in the main paper paths L1 to L3, jammed paper in the main paper paths L1 to L3 can be removed by opening the main paper paths L1 to L3 by pivoting the cover body 40 from the closed position shown in FIG. 2 to the opened position (not shown). On the other hand, in a case where a paper jam occurs in the reverse paper path Lb, jammed paper in the reverse paper path Lb can be removed by opening the reverse paper path Lb by pivoting the cover body 40 to the opened position and then pivoting the first cover portion 41 about the fulcrum shaft 43 toward the device main body M (right side in FIG. 2).

Here, as shown in FIGS. 1 and 3, an outer shape of the device main body M is composed of a casing body 100 as a housing. The casing body 100 includes a casing main body 110 and a cover portion 120.

The casing main body 110 covers substantially an entirety of the device main body M.

In a left lateral face of the casing main body 110, the abovementioned second cover portion 42 constituting the cover body 40 is disposed to be openable and closable.

The cover portion 120 is provided on a front face side of the casing body 100 (a side facing a user). The cover portion 120 is attached to the casing body 100 so as to be pivotable in a horizontal direction. By pivotally moving the cover portion 120 from the closed position to the opened position, a front portion inside the casing main body 110 is exposed. This allows a user to replace a toner cartridge 5 (described later), resolve a paper jam, maintain the copy machine and the like from a front face of the casing main body 110.

The abovementioned cover portion 120 is attached to the casing main body 110 so as to be disposed between the paper feeding cassette 52 and the ejected paper accumulating portion M1. The cover portion 120 is configured to be openable and closable, between a closed state shown in FIG. 1 and an opened state shown in FIG. 3 (second opened state). An opening 155 formed on the casing main body 110 is exposed in a state where the cover portion 120 is in the opened state (the second opened state) (see FIG. 3), and covered in a state where the cover portion 120 is in the closed state (see FIG. 1). The cover portion 120 enters the closed state where the opening 155 formed on the front face of the casing main body 110 is covered, by pivotal movement (closing) thereof toward the front face of the casing main body 110 from the opened state shown in FIG. 3. As shown in FIG. 3, in a case where the cover portion 120 is in the opened state, a framing portion 151 and a plurality of toner cartridges 5*a*, 5*b*, 5*c*, and 5*d* are exposed through the opening 155 of the casing main body 110. By pivotally moving (closing) the cover portion 120 from the opened state to the closed state, the cover portion 120 enters a concealed state where the framing portion 151 and the toner cartridges 5*a*, 5*b*, 5*c*, and 5*d* are covered. It should be noted that the framing portion 151 is a portion where the paper path L and the photoreceptor drums 2 in the device main body M are housed (covered).

The casing main body 110 further includes a decorative panel 130 that forms an outer face of the casing body 100 (see FIGS. 1 and 3). The decorative panel 130 is composed of a plurality of panels. The plurality of panels composing the decorative panel 130 are disposed to be aligned in a longitudinal direction (a vertical direction) on one end side of the front face of the casing main body 110 (on a left end side in FIGS. 1 and 3). The decorative panel 130 is configured to include: an upper panel 131; an intermediate panel 132 as a decorative portion; a first lower panel 133; and a second lower panel 134, from the top to the bottom in a vertical direction.

The upper panel 131 is disposed at a position corresponding to the ejected paper accumulating portion M1. The intermediate panel 132 is disposed at a position corresponding to the cover portion 120. The intermediate panel 132 is disposed to be aligned with the cover portion 120, on a side to the first pivotal axis 124 of the cover portion 120. Here, a length in a vertical direction of the intermediate panel 132 is substantially the same as a length in a vertical direction of the cover portion 120. The first lower panel 133 is disposed at a position corresponding to the paper feeding cassette 52 on an upper side. The second lower panel 134 is disposed at a position corresponding to the paper feeding cassette 52 on a lower side.

Here, in the present embodiment, the intermediate panel 132 is attached to the casing main body 110 so as to be pivotable in a horizontal direction.

Next, a structure of the cover portion 120 and the intermediate panel 132 is described with reference to FIGS. 4 to 7.

Figure 4:
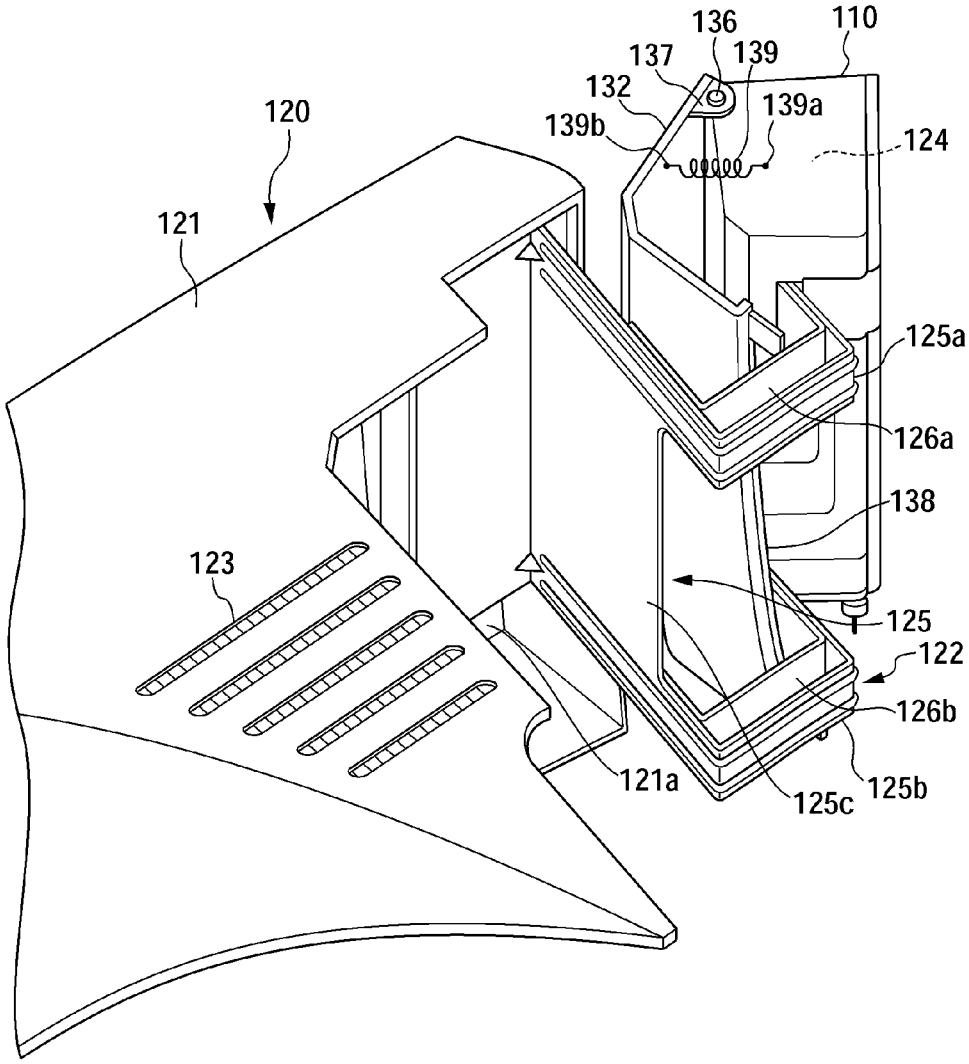
FIG. 4 is a perspective view illustrating a state where a cover portion 120 is opened (a second opened state)
Figure 5:
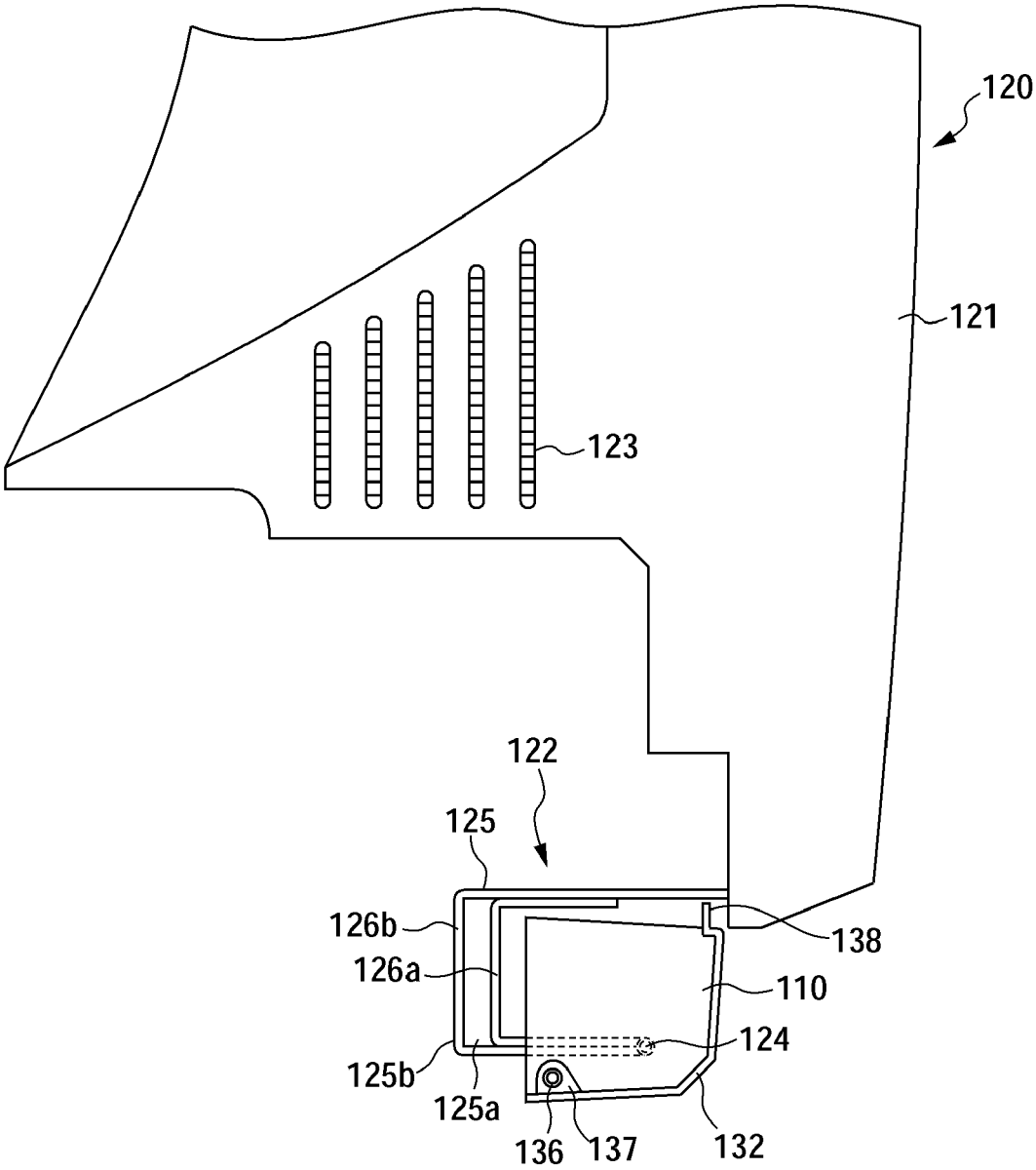
FIG. 5 is a plan view illustrating a state where the cover portion 120 is closed (a closed state)
Figure 6:
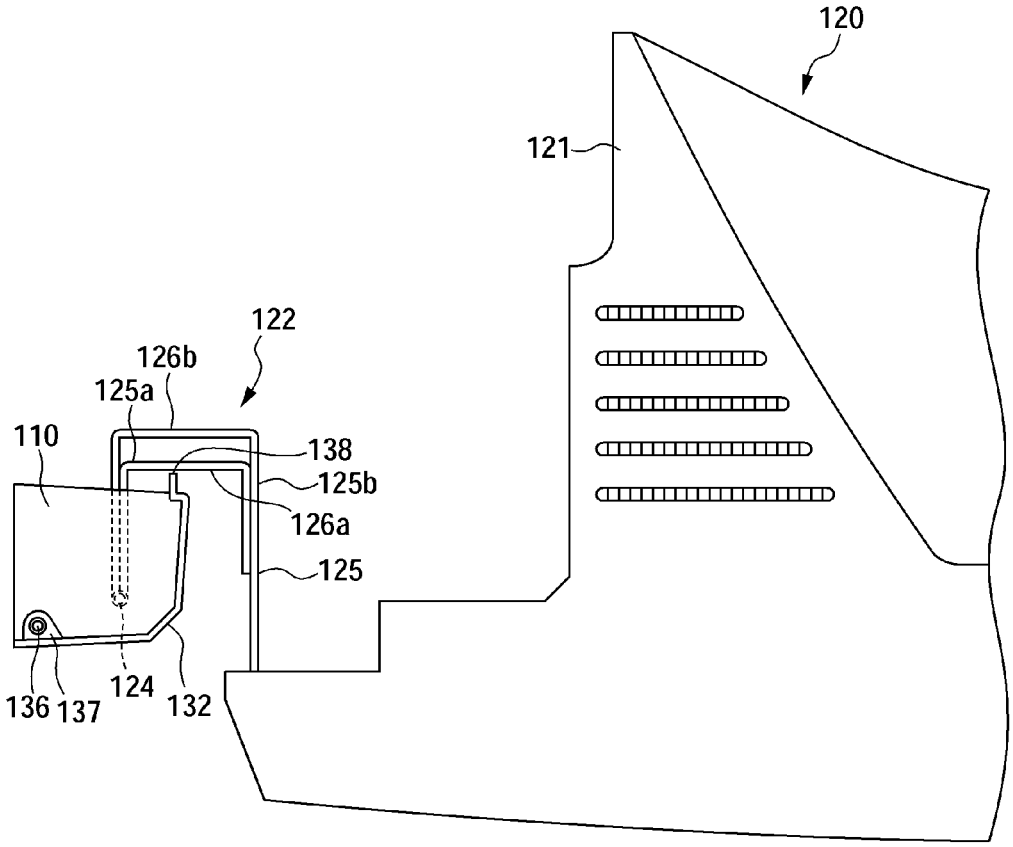
FIG. 6 is a plan view illustrating a first opened state where the cover portion 120 is opened to a first pivoted position.
Figure 7:
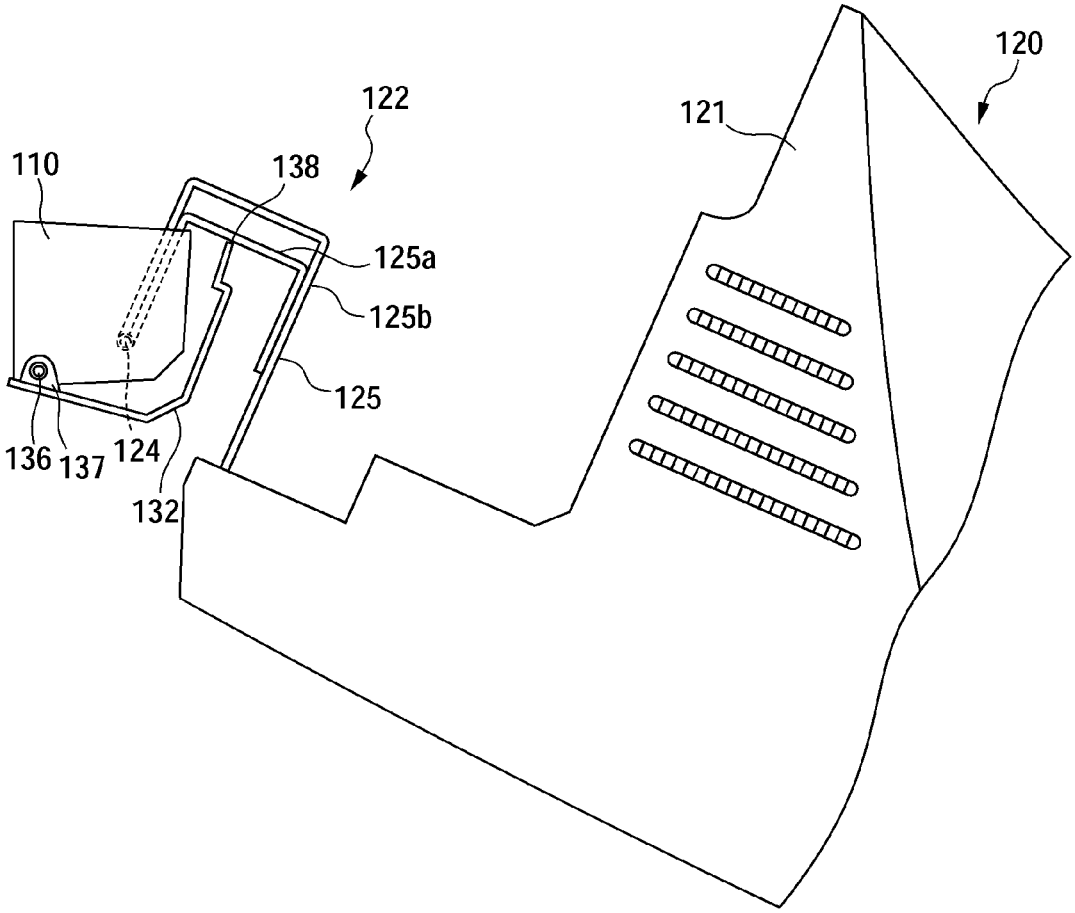
FIG. 7 is a plan view illustrating the second opened state where the cover portion 120 is opened to a second pivoted position.

FIG. 4 is a perspective view illustrating a state where a cover portion 120 is opened (a second opened state). FIG. 5 is a plan view illustrating a state where the cover portion 120 is closed (a closed state). FIG. 6 is a plan view illustrating a first opened state where the cover portion 120 is opened to a first pivoted position. FIG. 7 is a plan view illustrating the second opened state where the cover portion 120 is opened to a second pivoted position. The cover portion 120 is transitioned from a closed state (see FIG. 5) to a first opened state (see FIG. 6), and then to a second opened state (see FIG. 7). Here, the intermediate panel 132 is transitioned from a state A (see FIGS. 5 and 6), which is a closed state, to a state B (see FIG. 7), which is an opened state, in accordance with a change in state of the cover portion 120.

As shown in FIG. 4, the cover portion 120 includes a cover main body 121 and a first connecting portion 122.

The cover main body 121 is a cover member formed in a box shape, and covers the opening 155 (see FIG. 3) in which the toner cartridges 5 and the framing portion 151 are disposed. A vent hole 123 is formed on an upper face in a vertical direction of the cover main body 121. The vent hole 123 is provided in order to introduce outside air into a duct 90 (see FIG. 2) that is disposed between the fixing portion 9 and the toner cartridge 5*d*.

As shown in FIG. 5, the first connecting portion 122 includes a first pivotal axis 124.

The first pivotal axis 124 is disposed along a vertical direction, at a predetermined attachment location on the casing main body 110. The first pivotal axis 124 connects the first connecting portion 122 (connecting member 125) with the casing main body 110 so that the first connecting portion 122 is pivotable. In other words, the first pivotal axis 124 connects the cover main body 121 with the casing main body 110 via the first connecting portion 122 (connecting member 125) so that the cover main body 121 is pivotable.

In addition, the first connecting portion 122 includes the connecting member 125 that connects the first pivotal axis 124 with the cover main body 121.

The first pivotal axis 124 is disposed so as to extend in a vertical direction, on one end side of the connecting member 125.

The connecting member 125 is in contact with the intermediate panel 132 of the decorative panel 130, in a case where the cover main body 121 is in the first opened state (see FIG. 5) to the second opened state (see FIG. 6).

In addition, the connecting member 125 is formed in a U-shape when viewed from a direction in which the first pivotal axis 124 extends. More specifically, the connecting member 125 includes an upper lever 125*a* and a lower lever 125*b* that are bent in a U-shape, and a plate portion 125*c* that connects the upper lever 125*a* and the lower lever 125*b* (see FIG. 4).

The upper lever 125*a* and the lower lever 125*b* have a bend portion 126*a* and a bend portion 126*b*, respectively, that are formed in a bottom portion of the U-shape.

As described above, the first pivotal axis 124 is disposed on a first end side of the connecting member 125 so as to extend in a vertical direction. A second end side of the connecting member 125, which is an opposite side of the first pivotal axis 124, is connected with a back face portion 121*a* of the cover main body 121. In such a structure, by pivoting the connecting member 125 about the first pivotal axis 124 the entirety of the cover portion 120 pivots in a horizontal direction between a state (see FIG. 5) covering the opening 155 (see FIG. 3) and a state in which the opening 155 is exposed (see FIGS. 6 and 7). In other words, by pivoting the connecting member 125 about the first pivotal axis 124, the entirety of the cover portion 120 pivotally moves in a horizontal direction between a closed position (see FIG. 5) of a state covering the opening 155, a first pivoted position (see FIG. 6) of a state exposing opening 155, and a second pivoted position (see FIG. 7) that is more outward (in an opening direction) than the first pivoted position.

Since the intermediate panel 132, which restricts movement of the cover portion 120 in the opening direction, is configured to be pivotally movable, the cover portion 120 is pivotally moved over the first pivoted position (see FIG. 6) to the second pivoted position (see FIG. 7). For example, the cover portion 120 can be pivotally moved such that a pivot angle of pivotal movement about the first pivotal axis 124 is greater than 90 degrees, with 0 degrees being an angle in the closed position in a closed state (see FIG. 5).

As shown in FIGS. 5 to 7, the intermediate panel 132, which constitutes the decorative panel 130 and is disposed at a position corresponding to the cover portion 120, is attached to the casing main body 110 to be pivotable.

The intermediate panel 132 is attached to the casing main body 110 by means of a connecting bracket 137 as the second connecting portion and the second pivotal axis 136, to be pivotable. The second pivotal axis 136 penetrates the connecting bracket 137. The second pivotal axis 136 is attached to the casing main body 110 so as to extend in a vertical direction, and is disposed so as to be substantially parallel to the first pivotal axis 124. In such a configuration, the intermediate panel 132 is attached to the casing main body 110 in a pivotable state about the second pivotal axis 136.

The intermediate panel 132 is formed in the shape of a flexed plate, having an L-shaped cross section extending from the second pivotal axis 136 toward the cover portion 120. An end portion (end edge) 138 of the intermediate panel 132, on an opposite side of the second pivotal axis 136, is a free end. In a first state where the intermediate panel 132 is closed, the end portion 138 of the intermediate panel 132 is disposed in the vicinity of an end portion of the cover portion 120 (see FIG. 5). In other words, in a state where the intermediate panel 132 is closed, the end portion 138 is disposed in the vicinity of a corresponding end face of the cover main body 121 in the cover portion 120. Since the end portion 138 (free end) of the intermediate panel 132 is disposed in the vicinity of the cover main body 121 in a case where the cover main body 121 is in the closed state, generation of an unnecessarily large gap between the cover main body 121 and the intermediate panel 132, in a case where the cover main body 121 is in a closed state, can be avoided.

In a state A where the intermediate panel 132 is closed, in a case where the cover portion 120 pivots in the opening direction, the bend portion 126*a* and the bend portion 126*b* contact the end portion 138, which is a free end of the intermediate panel 132 (see FIG. 6). As the bend portions 126*a* and 126*b* contact the end portion 138, which is a free end of the intermediate panel 132, a pivotal force from the bend portions 126*a* and 126*b* is transmitted to the intermediate panel 132. The intermediate panel 132 thus pivots in the opening direction along with the cover portion 120, and enters a state B (opened state). In the present embodiment, the bend portion 126*a* and the bend portion 126*b* are configured to contact the end portion 138 at a moment where the cover portion 120 pivots 90 degrees with respect to the casing main body 110 (see FIG. 6).

As shown in FIG. 4, a return spring 139 as an example of a biasing portion is attached to the intermediate panel 132. The return spring 139 is a coil spring. A first end 139*a* of the return spring 139 is engaged with the casing main body 110 and a second end 139*b* thereof is engaged with a back face of the intermediate panel 132. As the intermediate panel 132 pivots in the opening direction, the return spring 139 is expanded and an elastic force is generated therein. In other words, the return spring 139 biases the intermediate panel 132 to pivot in a closing direction. Therefore, the intermediate panel 132 is biased by the return spring 139 so as always to close, in other words, the intermediate panel 132 is biased so as to maintain a state forming an outer face of the casing main body 110. Here, the return spring 139 is not limited to the abovementioned type and arrangement, and can also be a spring member directly attached to the second pivotal axis 136.

Subsequently, movement of the cover portion 120 is described with reference to FIGS. 5 to 7. Here, in FIG. 5, the pivot angle of the cover portion 120 with respect to the casing main body 110 is 0 degrees. In FIG. 6, the pivot angle of the cover portion 120 with respect to the casing main body 110 is 90 degrees. In FIG. 7, the pivot angle of the cover portion 120 with respect to the casing main body 110 is 120 degrees, which exceeds 90 degrees.

First, a user grips a grip portion 127 (see FIG. 3) that is provided in a concave shape on a lateral face of the cover main body 121, and pivots the cover portion 120 in the opening direction from the closed state shown in FIG. 5. The cover portion 120 thus pivots in the opening direction at the first pivotal axis 124, and enters the first opened state (see FIG. 6). As the cover portion 120 pivots in the opening direction, the connecting member 125 is turned clockwise (when viewed from above, see FIGS. 5 to 7) about the first pivotal axis 124 (see FIG. 6). In this state, the intermediate panel 132 maintains the state A (closed) by way of a biasing force of the return spring 139 (see FIG. 4).

Next, from a state shown in FIG. 6, the cover portion 120 is further pivoted in the opening direction. As a result, the cover portion 120 is transitioned from the first opened state to the second opened state. In other words, the cover portion 120 is pivotally moved from the first pivoted position to the second pivoted position. Consequently, as shown in FIG. 7, the connecting member 125 is in contact with the end portion 138 of the intermediate panel 132 and pivots the intermediate panel 132. More specifically, the bend portion 126*a* and the bend portion 126*b* of the upper lever 125*a* and the lower lever 125*b* contact the end portion 138 of the intermediate panel 132 and push the end portion 138 of the intermediate panel 132 in the opening direction in order to pivot the intermediate panel 132. In other words, by pivoting the cover portion 120, the intermediate panel 132 is also pivoted along with the cover portion 120, in a direction the same as the cover portion 120. By thus pivoting the intermediate panel 132, the cover portion 120 enters the second opened state with a pivot angle exceeding 90 degrees. The cover portion 120 opened with a pivot angle of at least 90 degrees facilitates replacement of the toner cartridge 5 and maintenance of the inside of the framing portion 151.

Here, by pivoting the cover portion 120 in a closing direction from a state shown in FIG. 7, the bend portion 126*a* and the bend portion 126*b* of the upper lever 125*a* and the lower lever 125*b* are spaced apart from the end portion 138 of the intermediate panel 132. The intermediate panel 132 returns from the state B (see FIG. 7) to the state A (see FIGS. 5 and 6) by a biasing force of the return spring 139 (see FIG. 4). The cover portion 120 is transitioned to the closed state shown in FIG. 5, via the first opened state shown in FIG. 6. The cover portion 120 is thus returned to a state with a pivot angle of 0 degrees, and enters the closed state.

According to the present embodiment, since the cover portion 120 can be pivoted to at least 90 degrees, an opening on a front face of the casing main body 110 can be widely exposed. This facilitates replacement of the toner cartridge 5 and maintenance of the casing main body 110.

In addition, according to the present embodiment, since the cover portion 120 pivots in the opening direction and the connecting member 125 is brought into contact with the intermediate panel 132 in order to pivot the intermediate panel 132, a user can smoothly pivotally move the cover portion 120.

Furthermore, according to the present embodiment, since the connecting member 125 of the cover portion 120 is brought into contact with the intermediate panel 132, there is no need to provide a separate member for contact therewith (for pivoting the intermediate panel 132). This can prevent the copy machine 1 from having a complex structure.

Moreover, according to the present embodiment, since the intermediate panel 132 is biased by the return spring 139 and automatically pivots (returns) in a closing direction, a user is not required to return the intermediate panel 132 in the state B (opened state) to the state A (closed state). This can improve operability of the copy machine 1.

A preferred embodiment of the present invention has been described above; however, the present invention is not limited thereto and can be carried out in various modes. For example, the copy machine 1 is exemplified in the present embodiment as an image forming apparatus; however, the present invention is not limited thereto and can be a printer, a facsimile machine, and a multi-functional peripheral having functions thereof.

In addition, in the present embodiment, the upper lever 125*a* and the lower lever 125*b* of the cover portion 120 contact the end portion 138 of the intermediate panel 132; however, the present invention is not limited thereto and, for example, a member dedicated for contact with the intermediate panel 132 can be provided on the cover portion 120.

Furthermore, in the present embodiment, only the intermediate panel 132 is pivotable; however, the present invention is not limited thereto and the whole decorative panel 130 may be made pivotable.

Moreover, in the present embodiment, the cover portion 120 and the intermediate panel 132 pivot about pivotal axes that are mutually different; however, the cover portion 120 and the intermediate panel 132 can pivot at the same pivotal axis (coaxially).

What is claimed is:

1. An image forming apparatus comprising:

a case main body having a plurality of lateral surfaces and an opening formed on a side to a first surface among the plurality of lateral surfaces;

a cover that can be disposed so as to cover the opening;

a first connection that connects the cover with the case main body so that the cover is pivotable about a first pivotal axis provided in the case main body and can switch between a closed state in which the opening is covered and an opened state in which the opening is exposed;

a decoration that is disposed to be aligned with the cover on a side to the first pivotal axis in the case main body, and forms the first surface of the case main body along with the cover, when the cover is in the closed state; and a second connection that connects the decoration with the case main body so that the decoration is pivotable about a second pivotal axis, which is provided in the case main body and is coaxial with or substantially parallel to the first pivotal axis, in a direction substantially the same as the cover, wherein the first connection:

is spaced apart from the decoration when the cover is in the closed state, and when the cover is in the opened state and pivotally moves about the first pivotal axis to exceed a predetermined pivoted position with respect to the case main body, the cover pivotally moves about a first pivotal axis while pivotally moving in contact with the decoration thereby pushing the decoration to pivotally move the decoration about a second pivotal axis.

2. The image forming apparatus according to claim 1, wherein the first connection has a connector that connects the first pivotal axis with the cover, and wherein the connector contacts a free end of the decoration in a state of forming the first surface, which is on an opposite side of the second pivotal axis, in a case where the cover is at a predetermined pivoted position in the opened state and pivotally moves the decoration about the second pivotal axis in a case where the cover pivotally moves to exceed the predetermined pivoted position.

3. The image forming apparatus according to claim 2, wherein the connector is formed in a U-shape when viewed from a direction of the first pivotal axis and contacts the free end of the decoration on a concave inner face of the U-shape.

4. The image forming apparatus according to claim 2, wherein the free end of the decoration is disposed in the vicinity of the cover in a case where the cover is in the closed state.

5. The image forming apparatus according to claim 1, further comprising a bias that biases the decoration so as to maintain a state forming the first surface of the case main body.

6. The image forming apparatus according to claim 1, wherein, in a state where the decoration is pivotally moved from a state forming the the first surface of the case main body, the cover is pivotally moved so as to make a pivot angle thereof greater than 90 degrees with reference to a pivot angle thereof in the closed state.

7. The image forming apparatus according to claim 1, wherein the decoration is disposed to be adjacent to the cover.

* * * * *